US005392623A

United States Patent [19]

Cueman et al.

[11] Patent Number: 5,392,623

[45] Date of Patent: Feb. 28, 1995

[54] SYSTEM FOR MONITORING A PILGER WALL

[75] Inventors: Michael K. Cueman, Niskayuna; Bahram Keramati, Scotia; George C. Sogoian, Glenville; John J. Kaehler, Scotia, all of N.Y.; Paul B. Tuck; James W. Clark, both of Wilmington, N.C.; Steven R. Hayashi, Schenectady, N.Y.

[73] Assignee: General Electric Company, Schenectady, N.Y.

[21] Appl. No.: 42,187

[22] Filed: Apr. 2, 1993

[51] Int. Cl.[6] ..... B21B 21/00

[52] U.S. Cl. ..... 72/11; 72/35; 72/214

[58] Field of Search ..... 72/21, 214, 11, 35, 72/209

[56] References Cited

U.S. PATENT DOCUMENTS

| | | | |
|---|---|---|---|
| 3,712,772 | 1/1973 | Hunkar | 425/141 |
| 3,936,713 | 2/1976 | Hunkar | 318/573 |
| 4,037,444 | 7/1977 | Ledebur et al. | 72/214 |
| 4,844,320 | 7/1989 | Stokes et al. | 228/102 |
| 4,955,220 | 9/1990 | Duerring | 72/214 |
| 5,101,366 | 3/1992 | Cueman et al. | 364/550 |
| 5,175,498 | 12/1992 | Cueman et al. | 324/225 |

FOREIGN PATENT DOCUMENTS

| | | | |
|---|---|---|---|
| 2461303 | 7/1976 | Germany | 72/214 |
| 0159204 | 9/1984 | Japan | 72/214 |
| 1692706 | 11/1991 | U.S.S.R. | 72/214 |

OTHER PUBLICATIONS

"Measurement Systems, Application and Design," Ernest O. Doebelin, Dept. of Mechanical Engineering, The Ohio State University, pp. 233–237.

*Primary Examiner*—Lowell A. Larson
*Assistant Examiner*—Thomas C. Schoeffler
*Attorney, Agent, or Firm*—R. Thomas Payne; James Magee, Jr.

[57] ABSTRACT

A system and method for monitoring a pilger mill having a crankshaft driving rolls with a reciprocating motion to reduce a tube over a mandrel. A linear sensor coupled to the mandrel supplies a mandrel position signal. A rotary sensor coupled to the crankshaft supplies a crankshaft angle signal. A processor for combining the mandrel position signal and the crankshaft angle signal provides a mandrel motion signal characteristic of the tube reduction.

25 Claims, 5 Drawing Sheets

SYSTEM FOR MONITORING A PILGER WALL

This invention relates to pilger mills, and more particularly to a system for monitoring tube reduction in the mill.

Pilger mills provide the means for reducing seamless pipes or tubing to be within desired dimensional tolerances. The pilgering apparatus includes a tapered mandrel on which the tube to be pilgered is mounted. Annular dies each having a peripheral circular groove are mounted to cooperate rotatably on a roll carriage or yoke. The yoke is oscillated forward and backward in a reciprocating motion along the tube axis, and the dies rotate in synchronism with the oscillations. As the dies are rotated, their grooves define a circular channel of progressively increasing or decreasing transverse cross section depending on the direction of rotation.

The tapered mandrel with the tube mounted on it extends through the channel defined by the rolls. The tube is advanced a short distance over the mandrel in steps following each full cycle of oscillation of the yoke. At the same time, both the tube and the mandrel are rotated about their common axis by a predetermined angle. The dies apply a high pressure to the tube during the reduction, and the dies and mandrel are formed of high strength tool steel to withstand the rolling pressure.

It has now been found that the axial motion of the mandrel during the pilger rolling can be correlated to the formation of tubing having a desirable or undesirable wall thickness as it is rolled. As a result, a real time system has been discovered for monitoring a pilger mill to determine if operating variables exist that cause an undesirable pattern of reduction in the tube wall thickness.

It is an aspect of this invention to provide a system for monitoring a pilger mill to determine if operating conditions exist that cause undesirable variation in the tube reduction.

BRIEF DESCRIPTION OF THE INVENTION

A system for monitoring a pilger mill having a crankshaft driving rolls with a reciprocating motion to reduce a tube over a mandrel. The system is comprised of a linear sensor coupled to the mandrel for supplying a mandrel position signal. A rotary sensor coupled to the crankshaft for supplying a crankshaft angle signal. A processor for combining the mandrel position signal and the crankshaft angle signal to provide a mandrel motion signal characteristic of the tube reduction.

A method for monitoring the pilger mill comprises, supplying a mandrel position signal correlated with an axial position of the mandrel. Supplying a crankshaft position signal correlated with an angular position of the crankshaft. Processing the mandrel position signal and the crankshaft position signal to provide a mandrel motion signal characteristic of the tube reduction.

DETAILED DESCRIPTION OF THE INVENTION

Figure 1:
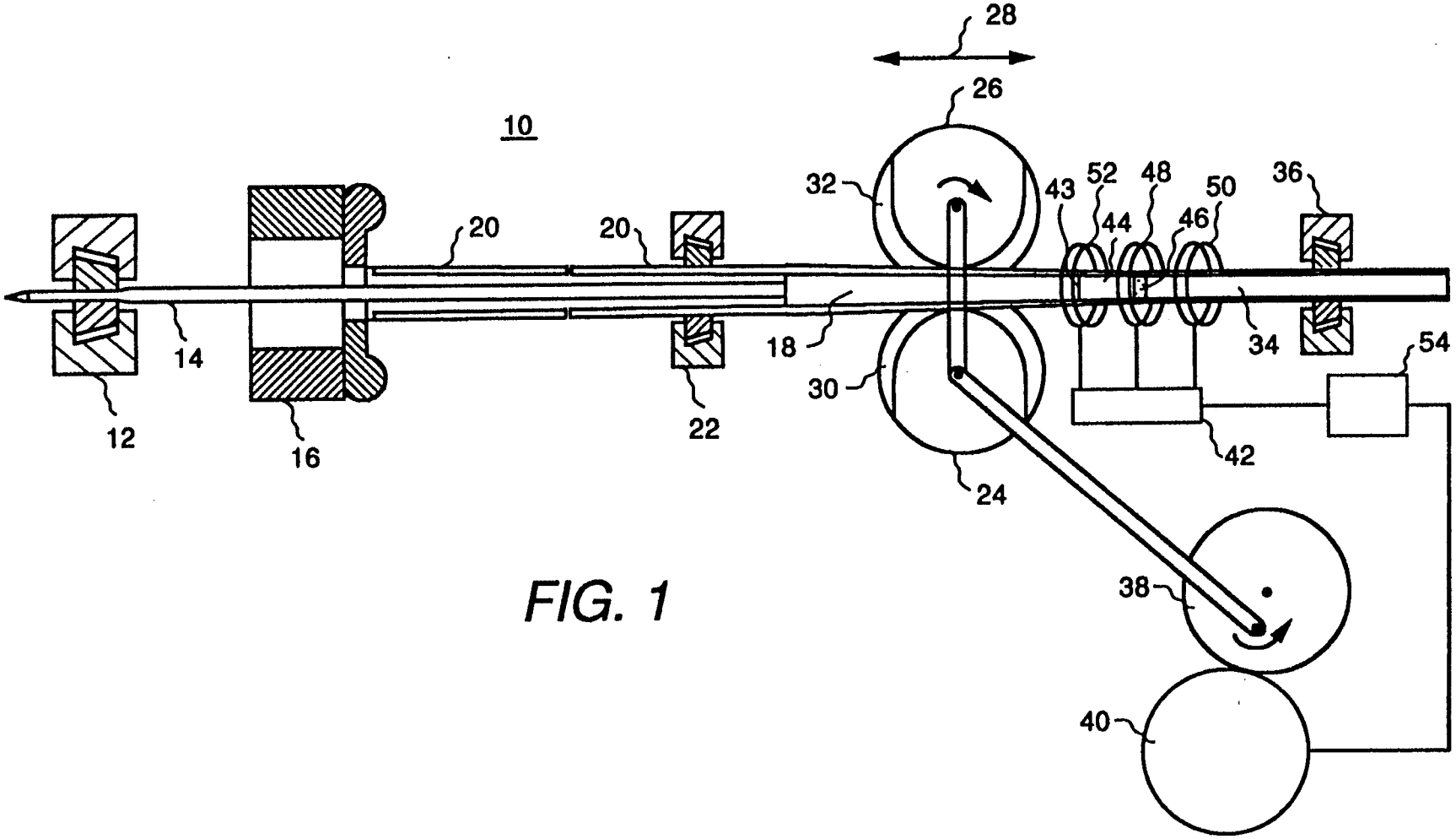
FIG. 1 is a schematic view of the system for monitoring a pilger mill.

FIG. 1 is a schematic illustration of a pilger mill 10. The pilger mill 10 includes a thrust block 12, supporting a rod 14 which extends through a feed carriage 16 to a mandrel die 18. In operation, ingoing tubes 20 are pushed by feed carriage 16 through entry chuck 22 and between spaced rolls 24 and 26. The rolls 24 and 26 rotate and undergo a reciprocating lateral movement as indicated by arrow 28. Grooves 30 and 32 in the rolls form a circular shaped pass which corresponds to the cross section of the ingoing tube. This pass tapers smoothly over a predetermined length of the roll circumference until it reaches the size of the finished tube 34 diameter. In this way, the ingoing tube is worked to the desired degree as the rolls carry out their reciprocating movement.

Elongation of the ingoing tube 20 to a finished tube 34 is affected through reductions in the diameter and wall thickness. The tube is elongated between the rolls 24 and 26, and the mandrel die 18. The mandrel die 18 tapers from the size of the inside diameter of the ingoing tube 20 to the inside diameter of the finished tube 34. The tube is elongated step wise over the stationary mandrel die 18. The mandrel die 18 is tapered in the direction of rolling. The two grooved rolls 24 and 26 embrace the tube from above and below, and roll over the tube for a predetermined length, called the pass length.

The rolls receive their reciprocating lateral movement from a saddle, not shown, in which they are mounted. At the same time, a reciprocating rotary movement is imparted to the rolls by pinions mounted on the roll shaft and engaging with racks which are fixed to the machine frame. The reciprocating stroke of the saddle plus rolls is effected by a crank drive 38. At the completion of each stroke, the entry chuck 22, and an exit chuck 36, grip the tube and rotate it a predetermined amount so that the entire circumference is evenly reduced between the rolls 24 and 26, and the mandrel die 18.

We have found that the force applied by the rolls in elongating the tube causes elongation and contraction of the mandrel die 18. In addition, it was found that the elongation and contraction of the mandrel die can be correlated with the rolling stroke of the rolls to provide a function or waveform characteristic of the tube reduction. When the mandrel die elongates and contracts in a cyclical repeating pattern, i.e. a repeating waveform, the tube is reduced to a uniform wall thickness and size. However, when the mandrel die elongates and contracts in a cyclical repetition of nonuniform patterns, i.e. an erratic repetition of waveforms, the tube reduction is nonuniform, and the desired wall thickness reduction is not achieved.

Referring to FIG. 1, a rotary sensor 40 for determining the angular position of the crankshaft is mechanically or optically coupled to crankshaft 42, and outputs a crankshaft angle signal proportional to the angular position of the crankshaft. For example, the rotary sensor 40 can provide an analog voltage ramp corresponding to the angular position of the crankshaft. The rotary sensor 40 also outputs a voltage pulse at every zero angle position of the shaft, for example, set at top dead center corresponding to the pilger saddle moving rolls 24 and 26 to the left limit position in FIG. 1. Examples of suitable rotary sensors are an optical encoder, resolver rotary transformer that determines shaft angle, potentiometer, rotary variable differential transformer, combination of gear teeth and proximity sensor or magnetic sensor, or the like. A preferred rotary sensor is a heavy duty shaft encoder model 470, with angular position monitor model SDC-2, Drive Control Systems, Eden Prairie, Minn.

A linear sensor 42 is coupled to the mandrel 18, to generate a mandrel position signal proportional to the position of a free end 43 of the mandrel measured with respect to a preselected reference position, e.g. the free end when the mandrel is unloaded. A suitable linear sensor is a linear voltage displacement transducer, LVDT, such as a type 503XE-3A obtained from Schaevitz Engineering, Pennsauken, N.J. The LVDT is comprised of a magnetic core 46, and a coil assembly of one primary coil 48 and two secondary coils 50 and 52 symmetrically spaced from the primary coil. The magnetic core 46 is mounted on a non-magnetic spacer 44, such as non-magnetic stainless steel, and the non-magnetic spacer is mounted on the free end 43 of the mandrel 18. The coil assembly is mounted axially to the magnetic core so the reduced tubing can extend therebetween.

The crankshaft angle signal and mandrel position signal are delivered to a processor 54, such as an oscilloscope, computer or microprocessor, for processing to display as a characteristic function of the pilger rolling process. For example, the analog signals can be sent to an oscilloscope for conventional processing to display the mandrel free end position as a function of the crankshaft angle position in a plurality of waveforms.

In another embodiment, the crankshaft angle signal and mandrel position signal are sent to an analog to digital converter coupled to a computer. The computer is conventionally programmed, for example using Lab Windows from National Instruments, to provide the function output signal corresponding to the mandrel position as a function of crank shaft angular position. The function output signal can be displayed by conventional means such as plotting on an X-Y recorder, or a video display as a plurality of waveforms. When the voltage pulse from the rotary sensor is detected, the plot is reset to the reference crankshaft position at the current mandrel free end position. In this way, a preselect number of the pilger rolling cycles can be plotted.

Figure 2:
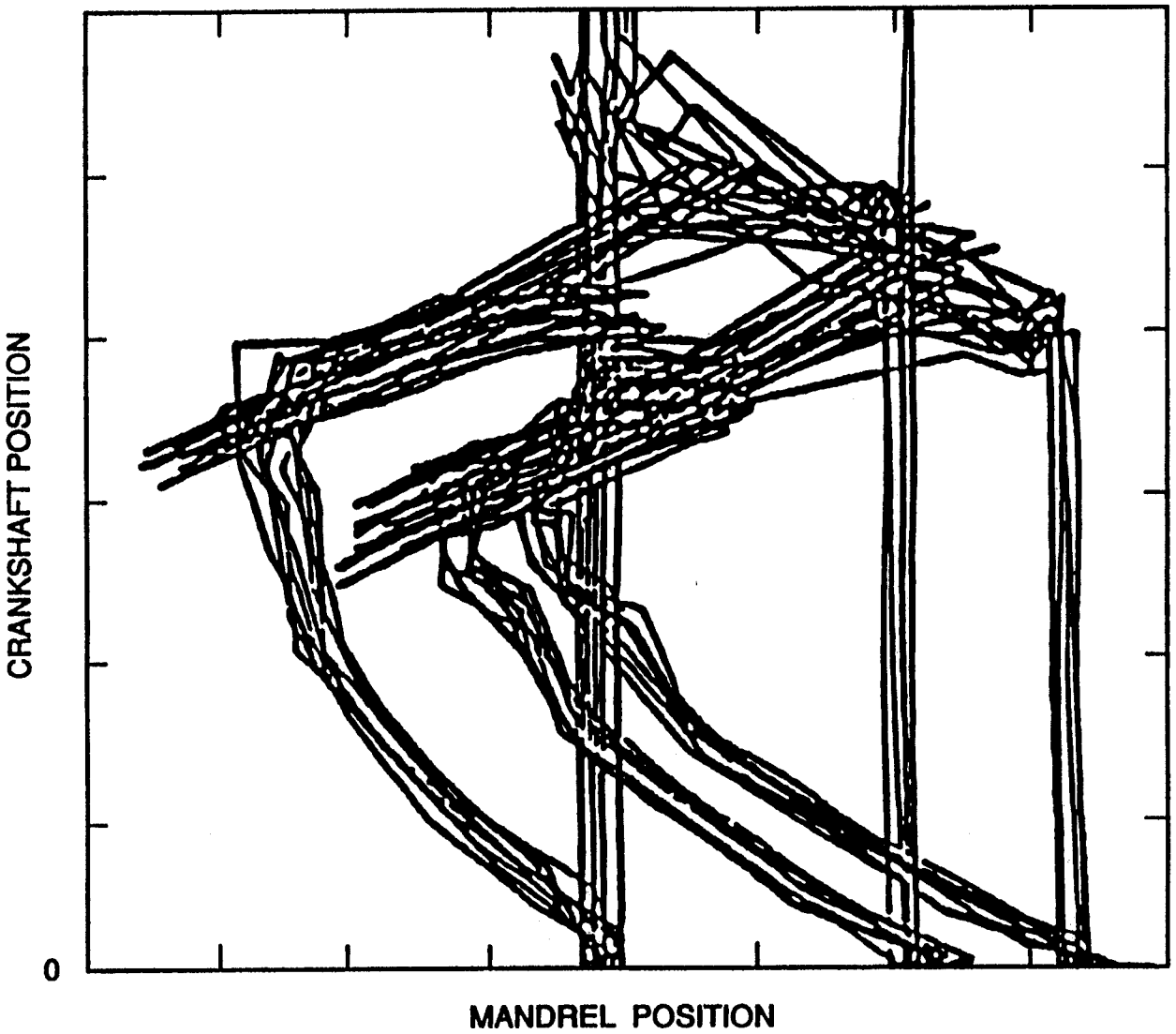
FIGS. 2–4 are graphs showing a representation of a waveform of the mandrel position as a function of the crankshaft position during reduction of a tube on a pilger mill.
Figure 3:
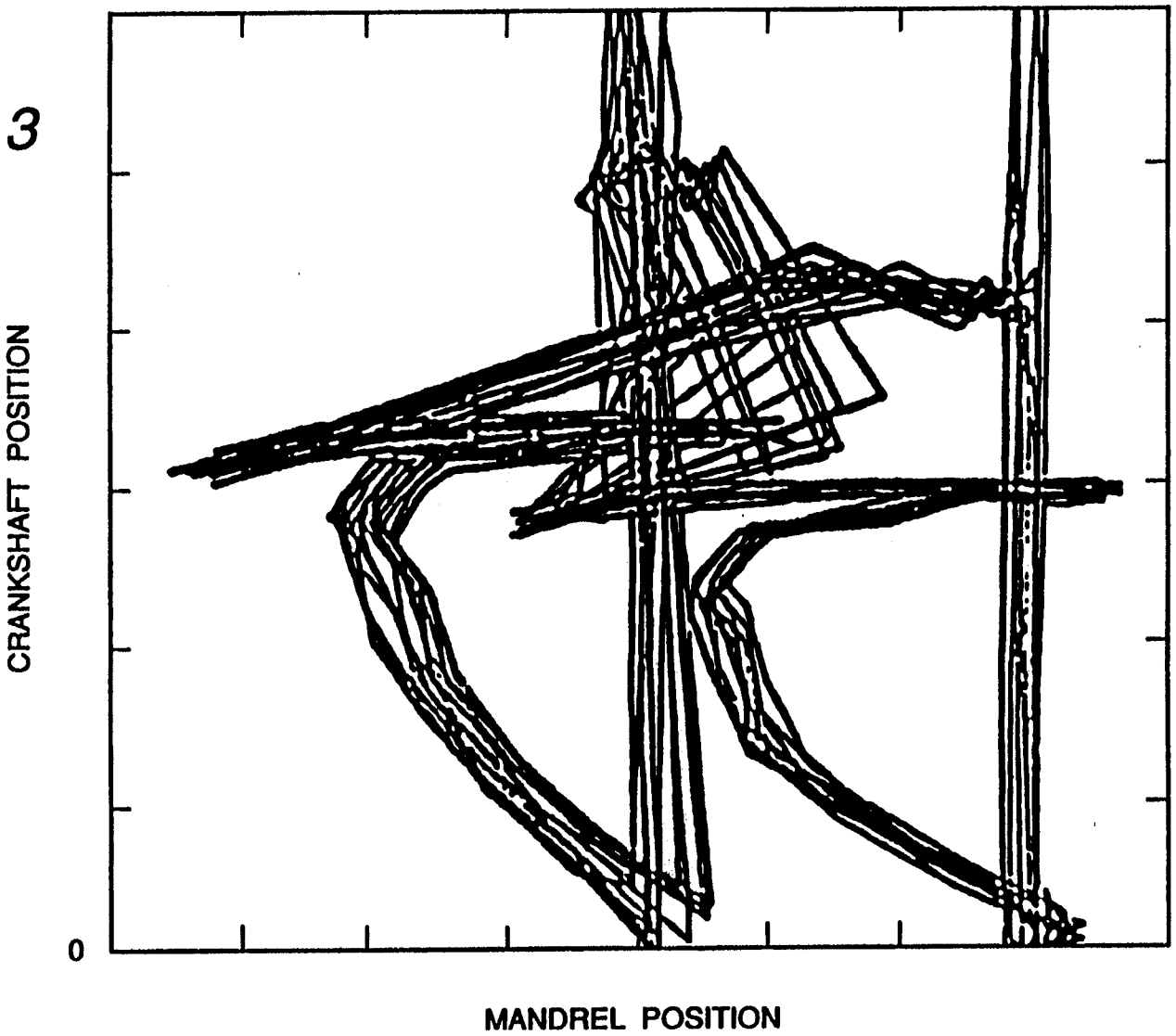

When the waveforms are repeating in a substantially uniform manner, the tubing is being reduced in a substantially uniform manner to a uniform size. Two or more separate mandrel movement patterns can be superimposed in the graph forming, for example dual or triple repeating patterns. FIGS. 2 and 3 are plots representative of the plurality of waveforms of mandrel free end position as a function of the crank shaft angle during the pilger rolling. FIG. 2 shows waveforms having a triplicate pilger mill rolling pattern, and FIG. 3 shows waveforms having a dual repeating pattern. The tubing reduced during such pilger rolling has a uniform size, such as wall thickness, or inside diameter.

Figure 4:
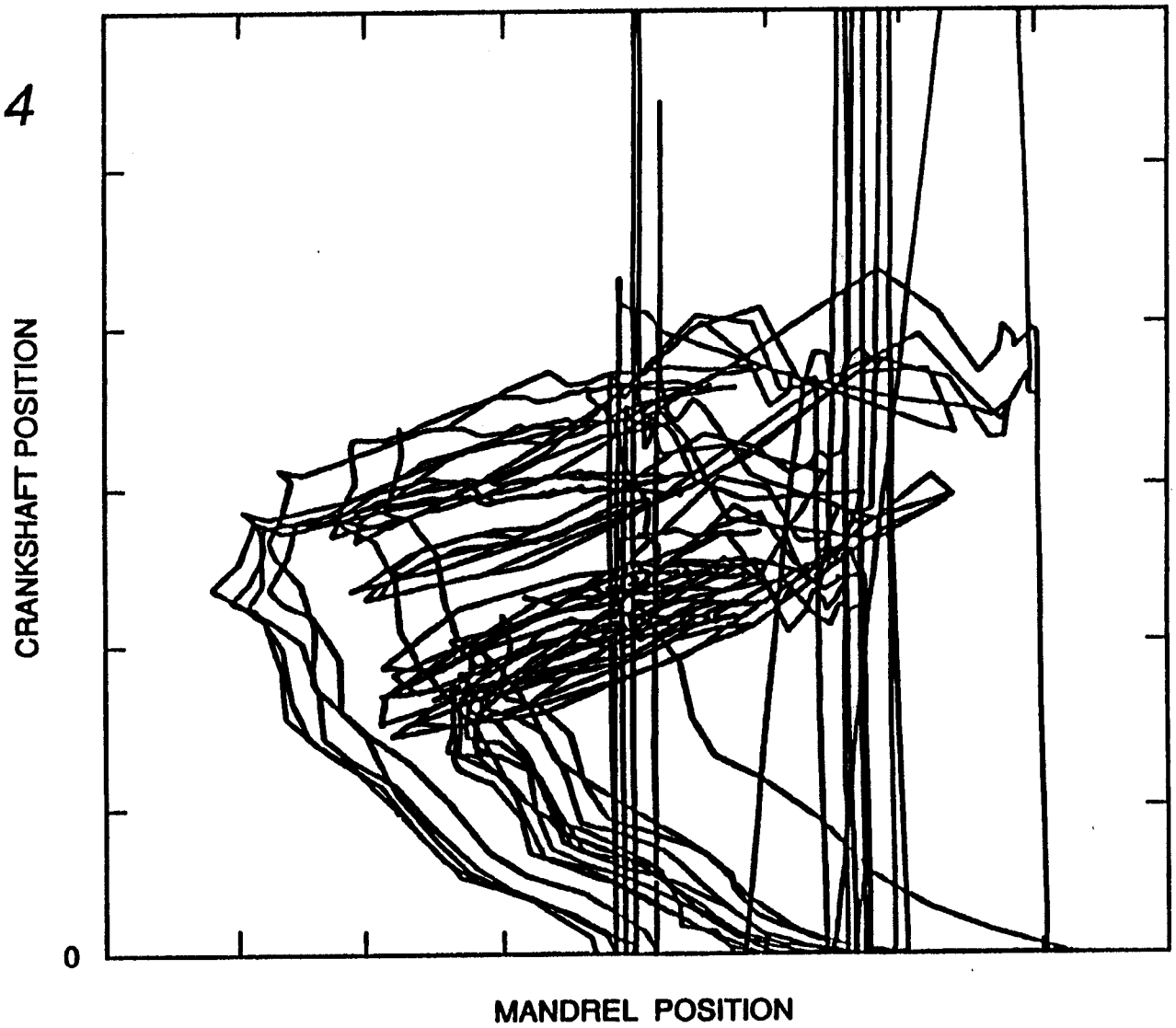
Figure 5:
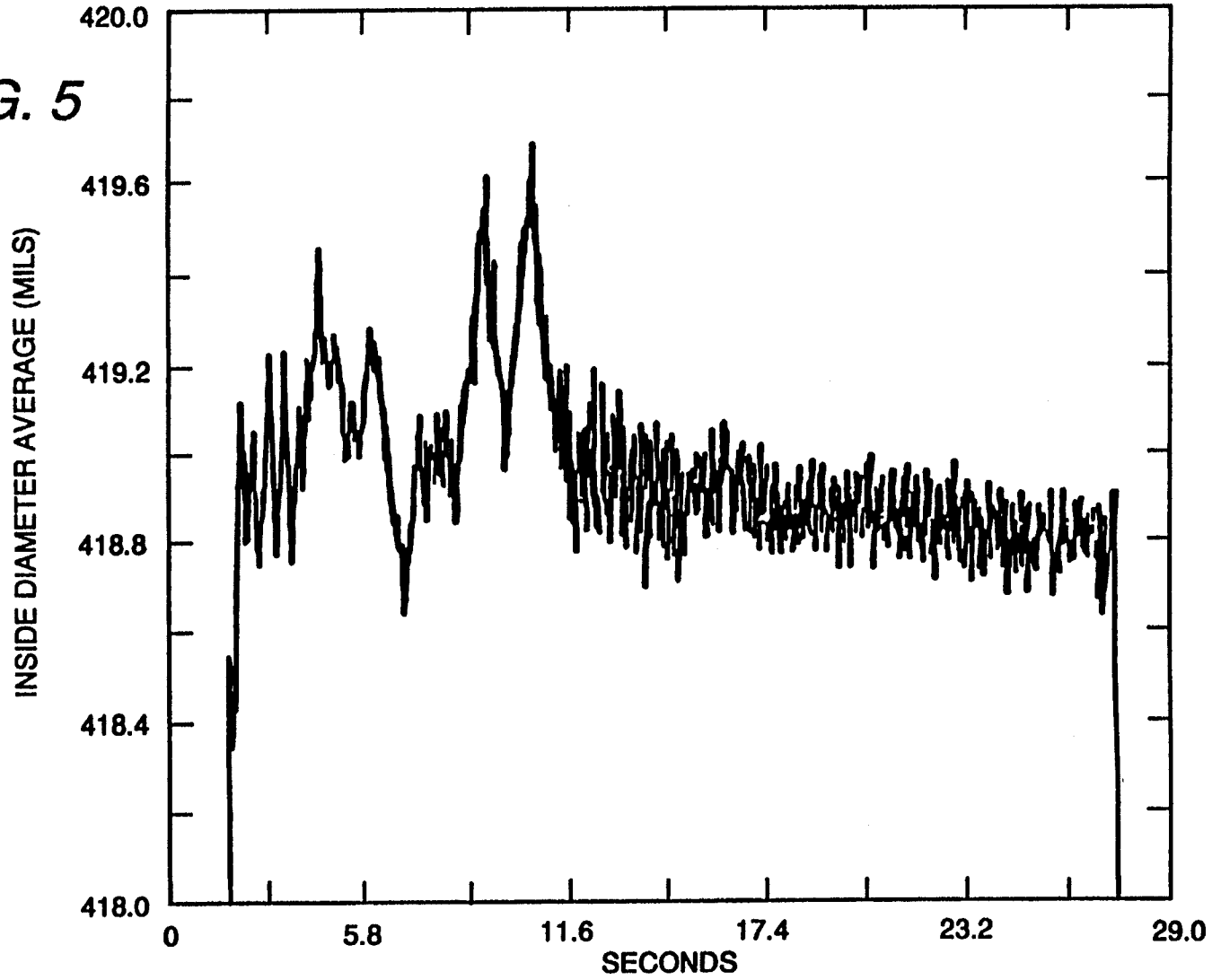
FIG. 5 is a graph of the wall thickness of a tube reduced on a pilger mill.

FIG. 4 is a plot representing nonuniform reduction of the tubing, as shown by the irregular non-repeating waveforms. Tubing reduced during such nonuniform reduction has an irregular and undesirable variation in size. For example, FIG. 5 is a graph showing the inside diameter of an elongated tube reduced in a pilger rolling apparatus. A transducer was traversed along the length of the tube to determine the inside diameter of the tube, as plotted on the ordinate, as a function of the traversing time of the transducer, as plotted on the abscissa. FIG. 5 shows tube measured in about the first 12 seconds has a nonuniform inside diameter formed during the type of reduction shown in FIG. 4, while the tubing measured thereafter has a more uniform inside diameter formed during the type of reduction shown in FIGS. 2 or 3.

What is claimed is:

1. A system for monitoring a pilger mill including a crankshaft driving rolls with a reciprocating motion to cyclically process a tube over a mandrel, the system comprising:

a sensor, operatively connected to the mandrel, for determining a mandrel position signal;

a sensor, operatively connected to the crankshaft, for determining a crankshaft angle signal; and a processors, operatively connected to the mandrel position signal sensor and the crank shaft angle signal sensor, for combining the mandrel position signal and the crankshaft angle signal and for providing an output such that when outputs from at least two cycles of the mill are uniformly displayed, the tube is being processed in a substantially uniform manner to substantially uniform size.

2. The system of claim 1 further comprising:

a display coupled to the processor for receiving the output and for displaying a waveform representation thereof.

3. The system of claim 1 wherein, the processor is an analog to digital converter coupled to a computer.

4. The system of claim 1 wherein, the mandrel position sensor comprises:

a magnetic core;

a non-magnetic spacer, operatively connected to the magnetic core at a free end of the mandrel; and a coil assembly for detecting movement of the magnetic core.

5. The system of claim 1 wherein, the rotary sensor is a rotary shaft encoder.

6. A method for monitoring a pilger mill which includes crankshaft driving rolls with a reciprocating motion to cyclically process a tube over a mandrel having a free end comprising the steps of:

providing a mandrel position signal correlated with an axial position of the mandrel;

providing a crankshaft position signal correlated with an angular position of the crankshaft; and processing the mandrel position signal and the crankshaft position signal to provide a mandrel motion signal representative of the mandrel free end position so that when the mandrel motion signal from at least two mill cycles are uniformly displayed, the tube is being processed in a substantially uniform manner to a substantially uniform size.

7. The method of claim 6 wherein the mandrel position signal is provided by a linear displacement transducer mounted axially to the mandrel.

8. The method of claim 6 wherein the crankshaft position signal is provided by a rotary shaft encoder coupled to the crankshaft.

9. The method of claim 6 wherein a plurality of mandrel position signals are displayed as plotting on an x-y recorder.

10. The method of claim 6 wherein a plurality of mandrel motion signals are displayed as a video display.

11. A system for producing a tube having a substantially uniform size, the system comprising:

a pilger mill including a feed carriage and an entry chuck;

at least two rotating and reciprocating spaced, grooved rolls;

a mandrel die having a predetermined rest position, operatively positioned relative to the rolls, for elongating the tube as the mandrel die elongates and contracts so that the entire circumference of the tube is reduced between the rolls and the die; and means, operatively connected to the rolls and the mandrel die, for determining a pattern representation of the elongation and contraction of the mandrel die relative to the predetermined rest position.

12. The system of claim 11, wherein when the mandrel die elongates and contracts in a cyclical repeating pattern, the resulting tube has a substantially uniform wall thickness.

13. The system of claim 11, wherein when the mandrel die elongates and contracts in a cyclical repeating pattern, the resulting tube has a substantially uniform size.

14. The system of claim 11, wherein the determining means comprises:

a sensor for determining the angular position of the crankshaft.

15. The system of claim 14, wherein the sensor is operatively connected to the crankshaft.

16. The system of claim 14, wherein the sensor produces an output proportional to the angular position of the crankshaft.

17. The system of claim 16, wherein the sensor is an optical encoder.

18. The system of claim 16, wherein the sensor is a combination of gear teeth in a proximity sensor.

19. The system of claim 16, wherein the sensor is a heavy-duty shaft encoder model 470, and angular position monitor model SDC-2.

20. The system of claim 11, wherein the determining means further comprises:

a sensor for generating a mandrel die position sensor signal proportional to the position of a free end of the mandrel die measured with respect to the preselected rest position, such as the free end when the mandrel is unloaded.

21. The system of claim 20, wherein the mandrel die position sensor is a linear voltage displacement transducer.

22. The system of claim 20, wherein the mandrel position signal sensor further comprises:

a magnetic core;

a coil assembly having one primary coil and two secondary coils, the secondary coils being symmetrically spaced from the primary coil; and a nonmagnetic spacer, for mounting the magnetic coil thereon such that the coil assembly is mounted axially to the magnetic coil for extending the tubing therebetween.

23. The system of claim 11, wherein the determining means further comprises:

a processor for displaying the mandrel free end positioned as a function of the crankshaft angle position.

24. The system of claim 11, wherein the determining means is an analog to digital converter operatively connected to a computer.

25. The system of claim 24, wherein when an output from the computer is displayed as a waveform, and at least two of the waveforms are repeating in a substantially uniform manner, the tubing is being reduced in a substantially manner to a substantially uniform size.

* * * * *

UNITED STATES PATENT AND TRADEMARK OFFICE

CERTIFICATE OF CORRECTION

PATENT NO. : 5,392,623

DATED : February 28, 1995

INVENTOR(S) : MK Cueman; B. Keramati; GC Sogoian; JJ Kaehler; PB Tuck; JW Clark; SR Hayashi

It is certified that error appears in the above-identified patent and that said Letters Patent is hereby corrected as shown below:

ON THE TITLE PAGE, ITEM [54];

Title should read: System for Monitoring a Pilger Mill

Signed and Sealed this

Second Day of May, 1995

*Attest:*

Bruce Lehman

BRUCE LEHMAN

*Attesting Officer*

*Commissioner of Patents and Trademarks*